US006631659B1

(12) United States Patent
Starikov et al.

(10) Patent No.: US 6,631,659 B1
(45) Date of Patent: Oct. 14, 2003

(54) VIBRATING NUTRUNNER

(76) Inventors: Ivan Vasilievich Starikov, Anglysky, 45-26, St. Petersburg I90008 (RU); Sergei Ruzhinsky, Revoldovich, Krasnoputilovakaya, 90-29, St. Petersburg I96191 (RU)

( * ) Notice: Subject to any disclaimer, the term of this patent is extended or adjusted under 35 U.S.C. 154(b) by 0 days.

(21) Appl. No.: 09/937,436

(22) PCT Filed: Mar. 26, 1999

(86) PCT No.: PCT/RU99/00094

§ 371 (c)(1),
(2), (4) Date: Jan. 22, 2002

(87) PCT Pub. No.: WO99/51403

PCT Pub. Date: Oct. 14, 1999

(30) Foreign Application Priority Data

Apr. 3, 1998 (RU) ..... 98106646

(51) Int. Cl.[7] ..... B25B 13/00

(52) U.S. Cl. ..... 81/54; 81/57.11

(58) Field of Search ..... 81/54, 57, 57.11

(56) References Cited

U.S. PATENT DOCUMENTS 3,886,821 A * 6/1975 Tokunaga et al. ..... 81/54
5,490,439 A 2/1996 Matsumura et al.

FOREIGN PATENT DOCUMENTS

| | | |
|---|---|---|
| RU | 2081741 C1 | 6/1997 |
| SU | 795927 | 1/1981 |
| SU | 967791 | 10/1982 |
| SU | 1771943 A1 | 2/1990 |

* cited by examiner

*Primary Examiner*—James G. Smith
(74) *Attorney, Agent, or Firm*—Simpson & Simpson PLLC

(57) ABSTRACT

The vibration nut wrench containing the body (1) with the control handle (2), the located into it drive (3) with the output shaft (4), the connected to it exciter of rotational oscillations designed in the form of two fly-wheels (5) and (6), connected to each other by the mechanism of variable speed (7) and the planetary reduction gear (8), the planet carrier (14) of which is directly connected to the spindle (15) of the wrench, which has the head for a wrench on its end specific in that the fly-wheel (6) of the exciter of rotational oscillations, located on the side of the planetary reduction gear, is supplied with the brake arrangement (16).

1 Claim, 1 Drawing Sheet

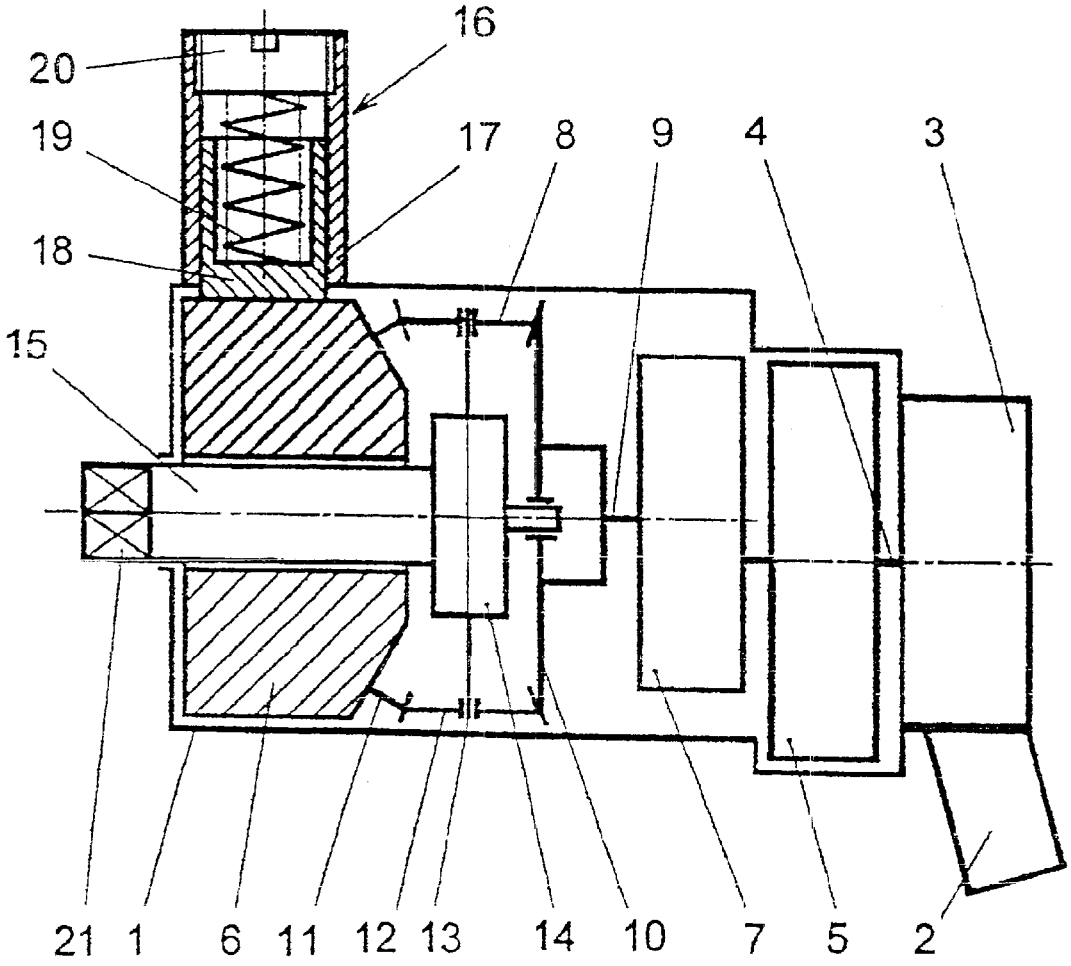
16
20
19
17
8
9
4
3
18
15
21
1
6
11
12
13
14
10
7
5
2

VIBRATING NUTRUNNER

TECHNICAL AREA

The invention belongs to portable hand tools with power drive using for assembling and disassembling of threaded connections and can be used for mechanization of installation works in different branches of industry.

PREVIOUS TECHNICAL SOLUTIONS

There is known an electrical vibration nut wrench, inventor's certificate SU, A, 795927, consisting of the body with the handle, the power drive with the output shaft located inside, the connected with the latter planetary reduction gear containing the central cog-wheels with inner and outer cogs and the planet carrier with satellites, the elastically damping clutch, the power shaft connected through the latter to the central cog-wheel with inside cogs, the cog-wheel fixed on the end of the power shaft, the exciter of rotary oscillations containing the liner, debalanced shafts, located inside, with cog-wheels for linkage with the cog wheel fixed on the power shaft, and the spindle with the head for a wrench, mounted on its end.

The electrical vibration wrench, the inventor's certificate SU, A, 967791, is additionally supplied with an ordinary free-wheel two-way clutch, the hoop of which is fixed strictly on the outer shaft of the drive's rotor, the warpage fork is strictly connected to the planet carrier of the reduction gear and the hub of the sprocket wheel is fixed so that it can rotate relatively the outer shaft of the rotor and is connected to the warpage fork though the spiral spring.

Known nut wrenches have big weight and size, and their kinematic scheme does not allow to achieve the desired minimal rotating moment of constant sign that is required to screw down threaded connections.

It is known, by the Inventor's certificate SU, A, 1771943, another vibration nut wrench. The wrench contains the body with the handle, the power drive with the output shaft and the exciter of rotary oscillations located inside. Into the body of the exciter of rotary oscillations there are placed debalanced shafts, the reduction gear and the spindle with the head for a wrench on its end. The spindle is strictly connected to the body of the exciter of rotary oscillations, and the reduction gear has cog-wheels with outer cogs mounted on the appropriate debalanced shaft, its cogs are in geared mesh with the cog-wheel with inner cogs, which is kinematically connected to the output shaft of the drive.

The shortage of the known wrench is the fact that its kinematic scheme does not allow to achieve the desired minimal rotating moment of constant sign at the control handle, under which screwing down of threaded connections is provided, because the exciter of rotary oscillations has sufficient turn-mass (debalanced shafts, heavy planet carrier) that is located at a long distance from the axis of rotation of the exciter.

The closest in its technical essence and the achieved effect, i.e., the prototype, is the vibration nut wrench by the RU, C1, 2081741 patent. The wrench contains the body with the control handle, inside it is located the power drive with the output shaft connected to the exciter of rotary oscillations and the spindle with with the head for a wrench on its end. The exciter of rotary oscillations is designed in the form of two fly-wheels connected to each other by the mechanism of variable speed of rotation and the planetary reduction gear. The carrier of the plabetary reduction gear is directly connected to the spindle of the wrench. When screwing a nut freely, the drive, through the mechanism of variable speed, turns the carrier of the planetary reduction gear that has far less mass than the fly-wheel. When the nut contacts the surface of the screwed detail, the carrier is stopped and the fly-wheel increase revolutions, putting in action the exciter of the rotary oscillations and tightening the threaded connection.

The construction of the known vibration nut wrench provides vibration oscillations of the exciter of rotary oscillations, under which the tightening torque will be more than the untightening torque. But the known nut wrench does not utilize energies of the fly-wheels because of faint difference between the amplitudes of vibration tightening and untightening torques. Besides, the known nut wrench does not allow to choose the most effective mode that minimizes the friction in thread.

DISCLOSURE OF THE INVENTION

The invention is based on the idea of increasing the amplitude difference of the shaft's turning when screwing and unscrewing and, thus, achieve a greater total vibration screwing, torque and so to increase the effectiveness of the action of the vibration wrench.

The raised problem is solved in the vibration nut wrench containing the body with the control handle, the drive with the output shaft located inside, the exciter of rotary oscillations connected to it and made in the form of two fly-wheels connected to each other by the mechanism of variable speed of rotation and the planetary reduction gear with the carrier of the latter connected directly to the shaft of the wrench with the head for a wrench on its end, according to the proposed invention, by that the fly-wheel of the exciter of rotary oscillations, located on the side of the planetary reduction gear, is equipped with brake.

Use of the brake device in the proposed vibration nut wrench makes it possible to provide additional damping of the fly-wheel of the exciter of rotary oscillations located on the side of the planetary reduction gear. The brake arrangement can be as with variable, as with constant braking effort. As a result of all this the turn amplitude of the drive and the associated shaft in the unscrewing direction is decreased, while in screwing direction it grows up, i.e., the difference between them is increased, and the total vibration torque will be directed to screwing. The possibility of regulation of the amplitude of oscillations makes it possible to find out the most effective operating mode, achieving the minimal friction in thread. All this will increase the effectiveness of the vibration wrench.

Let's consider a specific implementation of the vibration wrench on an example that does not, however, restrict the variety of its design.

SHORT DESCRIPTION OF THE FIGURE DRAWING

In the drawing it is presented the schematic diagram of the vibration nut wrench supplied with the brake arrangement with controllable braking effort.

VARIANTS OF DESIGN OF THE WRENCH

The vibration nut wrench contains the body 1 with the control handle 2. In the body 1 there are designed the drive 3 and the exciter of rotary oscillations connected to its output shaft 4. The exciter of the rotary oscillations is designed in the form of two fly-wheels 5 and 6 connected between each other by the mechanism of variable speed of rotation 7 and the planetary reduction gear 8. The Mechanism of variable speed of rotation 7 and the planetary reduction gear 8 can be designed in different ways. For example, the mechanism of variable speed of rotation can be designed in the known way from gears of non-circle form or in the form of link gear, and the planetary mechanism can be conic, cylindrical, or frictional.

The fly-wheel 5 is located on the output shaft 4 of the drive 3 connected also to the mechanism of variable speed of rotation 7, the shaft 9 of which is connected to the central (solar) pinion 10 of the planetary reduction gear 8. Another pinion 11 of the reduction gear 8 (epicycle) is strictly connected to the second fly-wheel 6 of the exciter of the rotary oscillations. The central pinions 10 and 11 are connected to each other by the satellites 12 fixed on the exes 13, which are strictly fixed on the carrier 14. The carrier 14 of the planetary reduction gear 8 is connected just to the spindle 15 of the wrench. The fly-wheel 6 of the exciter of rotary oscillations is supplied with the brake arrangement 16 that is designed as the shell 17 welded to the body 1. Inside the shell 17, it is placed the brake block 18 (designed in any form) jammed to the fly-wheel 19 by the spring 19. The amount of hold-down pressure of the brake block 18 is regulated by the threaded plug 20. On the end of the spindle 15 it is designed the square 21 for setting of interchangeable heads (not displayed in the figure) by a wrench.

The brake arrangement can be designed in many ways, for example, with use of known constructions of electromagnetic clutches, compressed air, i.e., with a turbine on the fly-wheel, permanent magnets, hydrodynamic clutches etc.

The vibration nut wrench works as follows. By screwing the threaded plug 20 of the brake arrangement 16 it is set the desired amount of hold-down pressure of the brake block to the fly-wheel 6, this pressure is supported during the whole process of screwing or unscrewing of threaded connections. The interchangeable working head (not displayed) is fixed on the nut (screwbolt) of a threaded connection. After pushing the button of the starting device (not displayed) the drive 3 is switched on transferring rotation through the output shaft 4 to the fly-wheel 5 and to the output shaft 9 of the mechanism of variable speed of rotation 7. The output shaft 9, in its turn, transfers rotation to the central solar pinion 10 of the planetary reduction gear 8, which, in its turn, through the satellites 12, initiate rotation of another central pinion (epicycle) 11 of the planetary reduction gear 8 and to the fly-wheel 6.

Art the zero time, when screwing resistance of the nut in a threaded connection is faint, rotation transfers from the pinion 10 to the satellites 12, which on their movement on the pinion initiate rotation of the carrier 14 that has, comparing the fly-wheel 6, lesser mass. The fly-wheel 6 also begin to spin up gradually, picking up speed, and the working head, fixed on the square 21 of the spindle 15, pick up rotation as well as the carrier 14. Thus, free screwing of the nut of a threaded connection takes place.

At the moment of contact of the nut of a threaded connection and the surface of the threaded device, resistance to rotation of the spindle 15 and the carrier 14 is increased, and the fly-wheel 6, under the influence of the rotational moment of constant sign of the drive 3, begin to pick up rotation itself fast, initiating the exciter of rotation oscillations and carrying out screwing of the threaded connection. Thus the carrier 14 will be loaded with the force consisting of the directed to the screwing direction rotational moment of the constant sign and the vibration moment of the excite of rotational oscillations.

In the process of free screwing on of a nut and in the process of screwing down of a threaded connection, the output shaft 9 of the mechanism of variable speed 7 has variable speed when rotating, i.e., its rotation accelerates or slows down.

In the process of vibration screwing on, when the speed of rotation of the output shaft 9 is decreased, braking of the solar pinion 10 takes place, and it initiate braking of the fly-wheel 6 that has gathered kinematical energy in the process of rotation. The liberated energy is partially dissipated by the braking arrangement 16, and its other part, through the epicycle 11 and the satellites 12 transfers to the carrier 14 and the spindle 15, which turns in the direction of screwing on at the certain angle, and to the fly-wheel 5, speeding it up. Simultaneously, rotary moment of constant sign is transferred from the drive 3 to the fly-wheel 5, speeding it up.

In the process of vibration screwing down, when the speed of rotation of the output shaft of the mechanism of variable speed 7 is decreased, speeding up of the solar pinion 10 takes place, this through the satellites 12 pinion turns the carrier 14 and the spindle 15 in the opposite direction, i.e., in the direction of screwing down of the nut and, at the same time, accelerates the fly-wheel 6. The brake block 18 keeps the fly-wheel 6 from speedup. On account of the additional energy, received by the fly-wheel 5 from the fly-wheel 6 when decreasing the speed of rotation of the output shaft 9 of the mechanism of variable speed 7, in the process of screwing down of the nut, the carrier 14 and the spindle 15 will be turned at the larger angle than when screwing out.

As a result of all this, with each rotation of the output shaft 9 of the mechanism of variable speed 7, the threaded connection will be screwed down. Regulating pressure force of the brake block 18 by the threaded plug 20 makes it possible to increase the amplitude of the vibration torque on the spindle 15 in the direction of screwing down and so to increase the effectiveness of the vibration nut wrench.

Under the selected in advance effort, the brake arrangement 16 can become uncontrollable, for example, when constant magnets are used for braking.

INDUSTRIAL APLICABILITY

The invention can be used in hand portable tools with power drive designed for assembling and disassembling of threaded connections, screwing on and screwing out of screws, chasing, drilling.

We claim:

1. A vibrating nut wrench comprising a body having a drive means, said drive means being connected, in series, to a first fly wheel, a variable speed control means, a planetary gear reduction means and a second fly wheel, wherein said second fly wheel includes a brake mechanism.

* * * * *